US012420139B2

(12) United States Patent
Reeves

(10) Patent No.: US 12,420,139 B2
(45) Date of Patent: Sep. 23, 2025

(54) EXERCISE APPARATUS FOR STRENGTHENING LEG MUSCLES

(71) Applicant: Kerry Reeves, McAllen, TX (US)

(72) Inventor: Kerry Reeves, McAllen, TX (US)

( * ) Notice: Subject to any disclaimer, the term of this patent is extended or adjusted under 35 U.S.C. 154(b) by 155 days.

(21) Appl. No.: 18/383,954

(22) Filed: Oct. 26, 2023

(65) Prior Publication Data

US 2025/0135277 A1 May 1, 2025

(51) Int. Cl.

| | |
|---|---|
| ***A63B 23/04*** | (2006.01) |
| ***A63B 21/00*** | (2006.01) |
| ***A63B 21/06*** | (2006.01) |
| ***A63B 23/035*** | (2006.01) |

(52) U.S. Cl.

CPC ..... *A63B 23/0405* (2013.01); *A63B 21/0615* (2013.01); *A63B 21/4029* (2015.10); *A63B 21/4034* (2015.10); *A63B 21/4035* (2015.10); *A63B 23/03525* (2013.01); *A63B 2208/0247* (2013.01); *A63B 2208/0252* (2013.01)

(58) Field of Classification Search

CPC ..... A63B 21/0615; A63B 21/0616; A63B 21/159; A63B 21/4029; A63B 21/4031; A63B 21/4034; A63B 21/4035; A63B 21/4047; A63B 23/03525; A63B 23/0405; A63B 2208/0247; A63B 2208/0252; A63B 2244/09

See application file for complete search history.

(56) References Cited

U.S. PATENT DOCUMENTS 4,509,746 A * 4/1985 Mask ..... A63B 21/4029 482/142
4,546,968 A * 10/1985 Silberman ..... A63B 23/03516 482/97
4,662,631 A * 5/1987 Seal ..... A63B 21/4029 482/104
4,696,469 A * 9/1987 Elder ..... A63B 21/4029 482/142
4,813,666 A * 3/1989 Costilow ..... A63B 21/4047 482/80
4,883,269 A * 11/1989 Shaver ..... A63B 23/03525 482/138
4,949,958 A * 8/1990 Richey ..... A63B 21/4029 482/96
5,011,140 A * 4/1991 Adessi ..... A63B 23/00 482/138
5,066,004 A * 11/1991 Jones ..... A63B 21/4047 482/142
D351,634 S * 10/1994 Cheng ..... D21/676
5,395,295 A * 3/1995 Ish, III ..... A63B 21/4047 482/133
5,429,570 A * 7/1995 Beyer ..... A63B 21/078 482/106

(Continued)

*Primary Examiner* — Gary D Urbiel Goldner

(57) ABSTRACT

An exercise apparatus for performing a resistance exercise to strengthen leg muscles includes a base and a platform coupled to a top side of the base. A weight support is pivotally coupled to the base and is spaced forwardly of the platform with respect to the base. The weight support is shaped such that the weight support is configured to support a weight. A lever is fixedly coupled to the weight support and pivotally coupled to the base. A foot engagement member is coupled to the lever and is shaped such that the foot engagement member is configured to be pulled toward the platform via a foot of a user.

16 Claims, 9 Drawing Sheets

(56) References Cited

U.S. PATENT DOCUMENTS

| | | | | | |
|---|---|---|---|---|---|
| D366,915 | S * | 2/1996 | Clem | D21/676 | |
| D384,116 | S * | 9/1997 | Brefka | D21/676 | |
| 5,665,034 | A * | 9/1997 | Hwang | A63B 21/4035 | 482/112 |
| D390,287 | S * | 2/1998 | Hsieh | D21/676 | |
| 5,882,283 | A * | 3/1999 | Stevens | A63B 21/078 | 482/142 |
| D462,730 | S * | 9/2002 | Cormier | D21/676 | |
| 6,976,944 | B1 * | 12/2005 | Damasio | A61H 1/0292 | 482/142 |
| 2005/0049121 | A1 * | 3/2005 | Dalebout | A63B 21/078 | 482/129 |
| 2009/0118104 | A1 * | 5/2009 | Chou | A63B 21/08 | 482/94 |
| 2016/0213968 | A1 * | 7/2016 | Boss | A63B 69/0062 | |
| 2021/0113878 | A1 * | 4/2021 | Stinton | A63B 23/03508 | |
| 2021/0170217 | A1 * | 6/2021 | Baluch | A63B 23/0233 | |

* cited by examiner

EXERCISE APPARATUS FOR STRENGTHENING LEG MUSCLES

(b) CROSS-REFERENCE TO RELATED APPLICATIONS

Not Applicable

(c) STATEMENT REGARDING FEDERALLY SPONSORED RESEARCH OR DEVELOPMENT

Not Applicable

(d) THE NAMES OF THE PARTIES TO A JOINT RESEARCH AGREEMENT

Not Applicable

(e) INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

(f) STATEMENT REGARDING PRIOR DISCLOSURES BY THE INVENTOR OR JOINT INVENTOR

Not Applicable

(g) BACKGROUND OF THE INVENTION

(1) Field of the Invention

The disclosure relates to exercise apparatus and more particularly pertains to a new exercise apparatus for performing a resistance exercise to strengthen leg muscles.

(2) Description of Related Art Including Information Disclosed Under 37 CFR 1.97 and 1.98

The prior art describes myriad exercise apparatuses for strengthening leg muscles. However, the prior art fails to disclose such an apparatus with a lever that is pivotable by pulling the lever toward a user's chest using the user's feet, the lever being fixedly attached to a weight support configured for holding weights.

(h) BRIEF SUMMARY OF THE INVENTION

An embodiment of the disclosure meets the needs presented above by generally comprising a base and a platform coupled to a top side of the base. A weight support is pivotally coupled to the base and is spaced forwardly of the platform with respect to the base. The weight support is shaped such that the weight support is configured to support a weight. A lever is fixedly coupled to the weight support and pivotally coupled to the base. A foot engagement member is coupled to the lever and is shaped such that the foot engagement member is configured to be pulled toward the platform via a foot of a user.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

(i) BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

(j) DETAILED DESCRIPTION OF THE INVENTION

Figure 1:
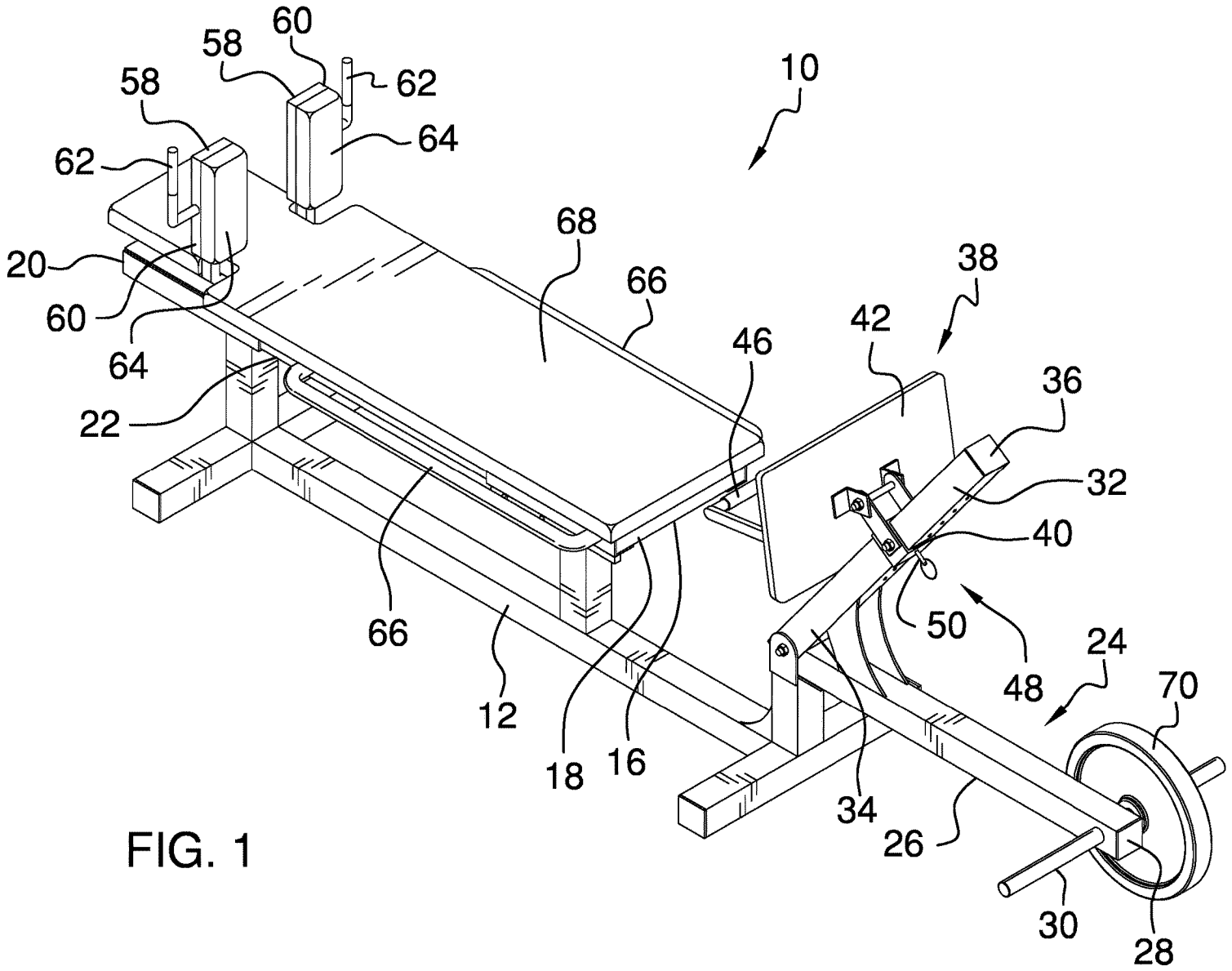
FIG. 1 is a perspective view of an exercise apparatus according to an embodiment of the disclosure.
Figure 2:
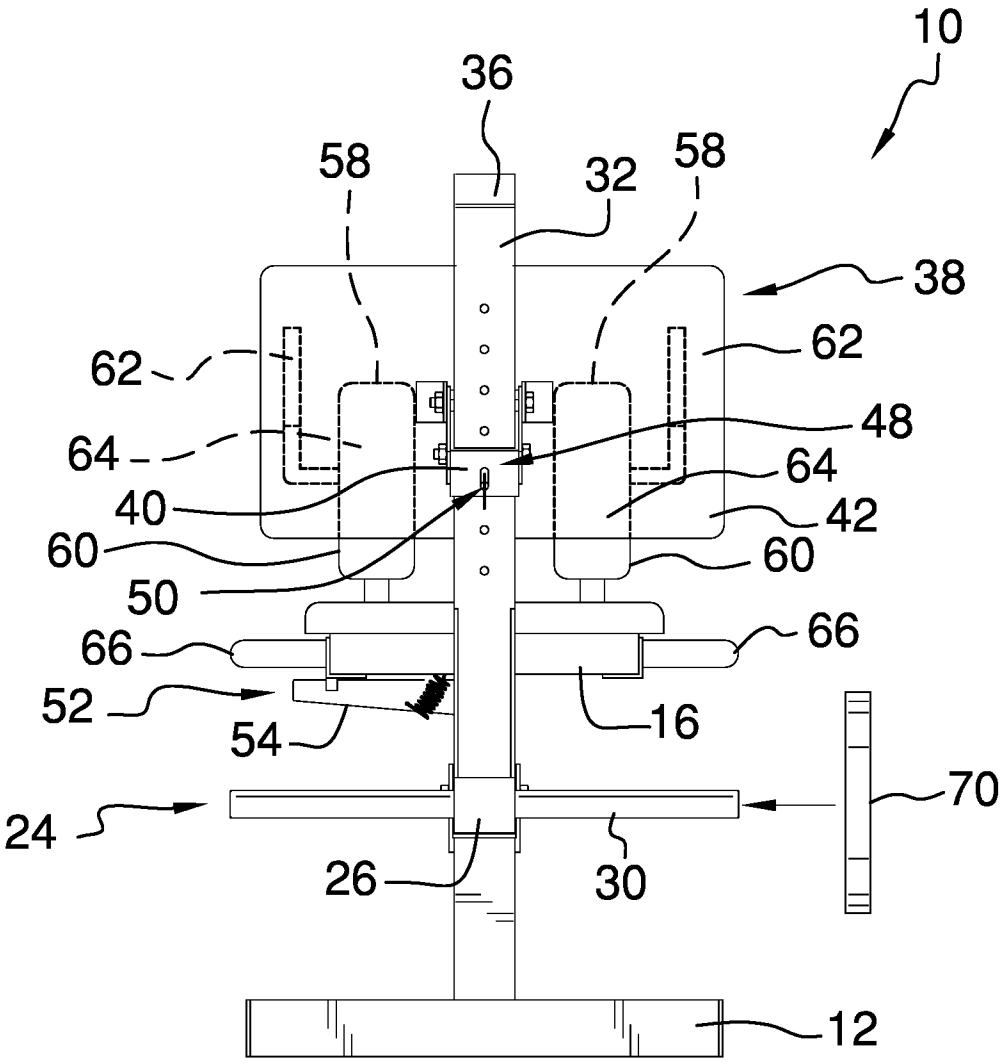
FIG. 2 is a front view of an embodiment of the disclosure.
Figure 3:
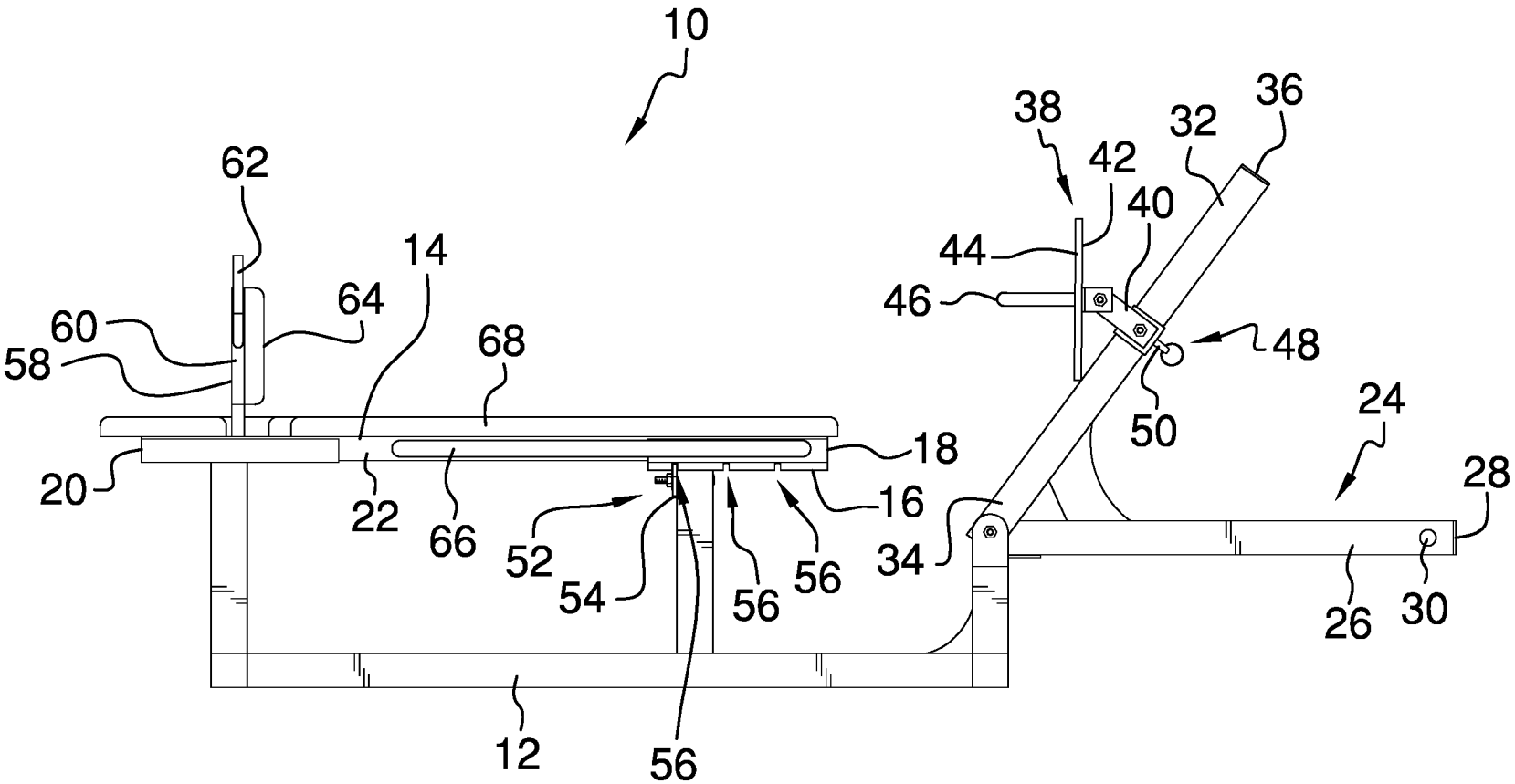
FIG. 3 is a side view of an embodiment of the disclosure.
Figure 4:
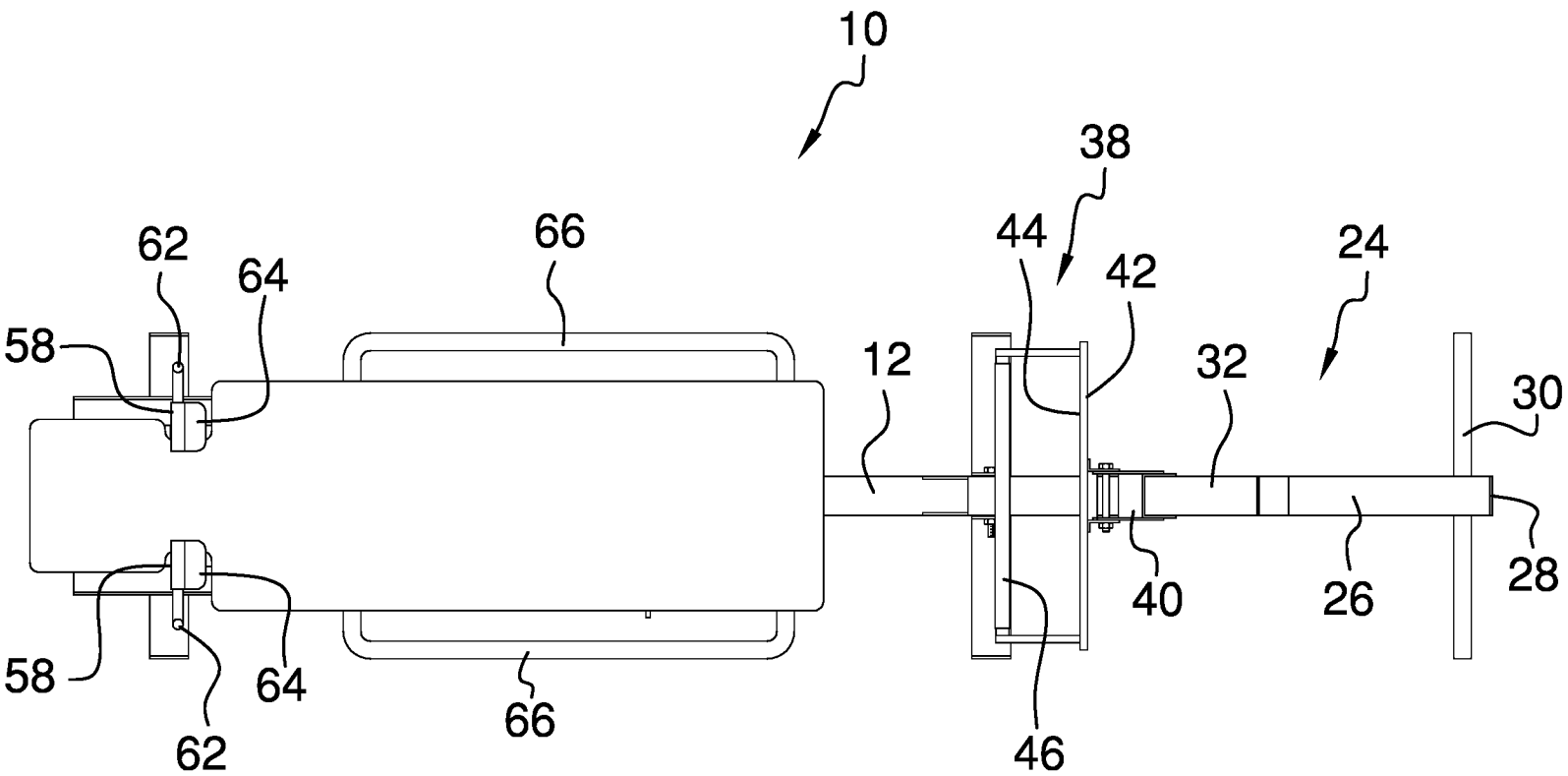
FIG. 4 is a top view of an embodiment of the disclosure.
Figure 5:
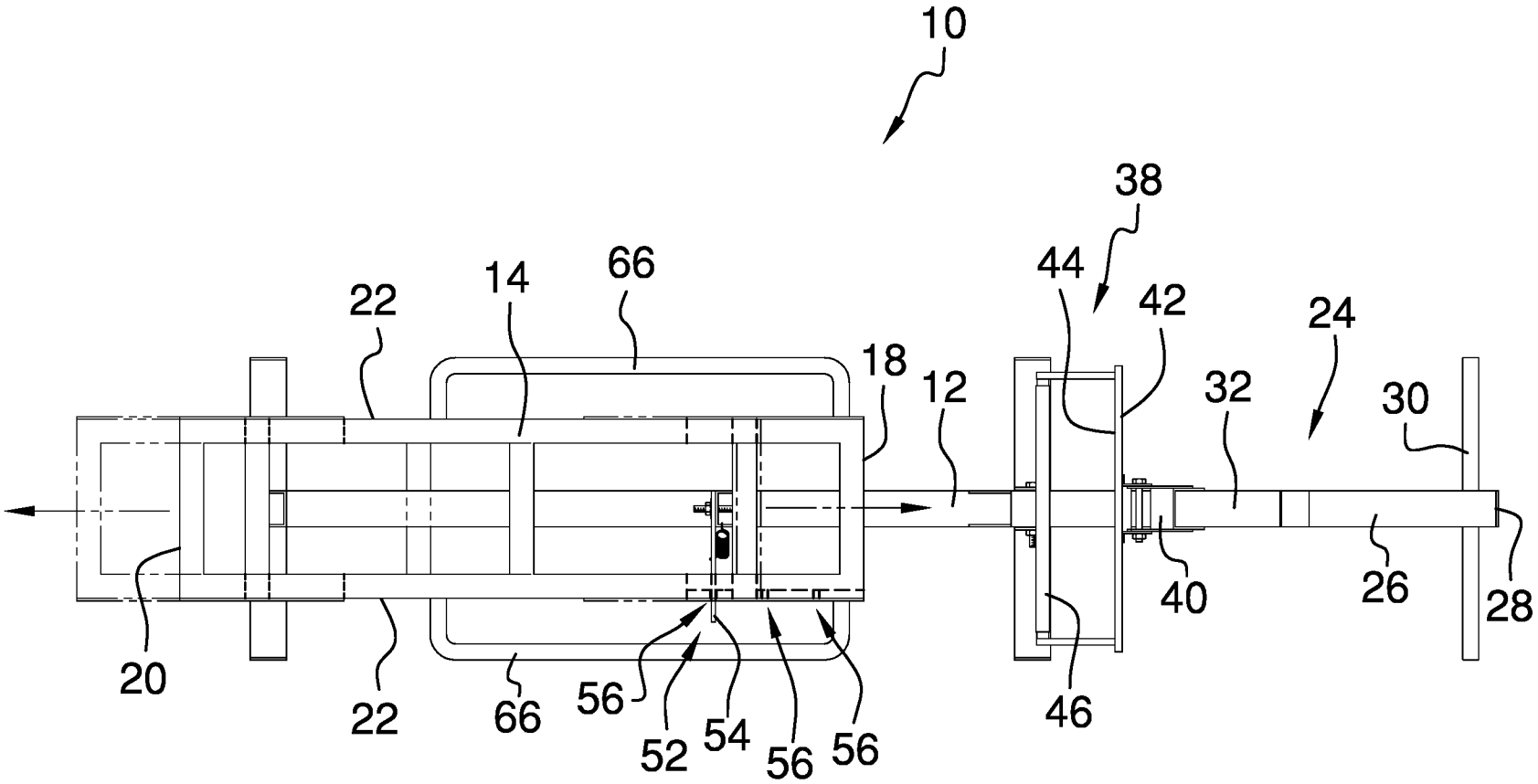
FIG. 5 is a top view of an embodiment of the disclosure with a platform cushion and a pair of shoulder cushions removed.
Figure 6:
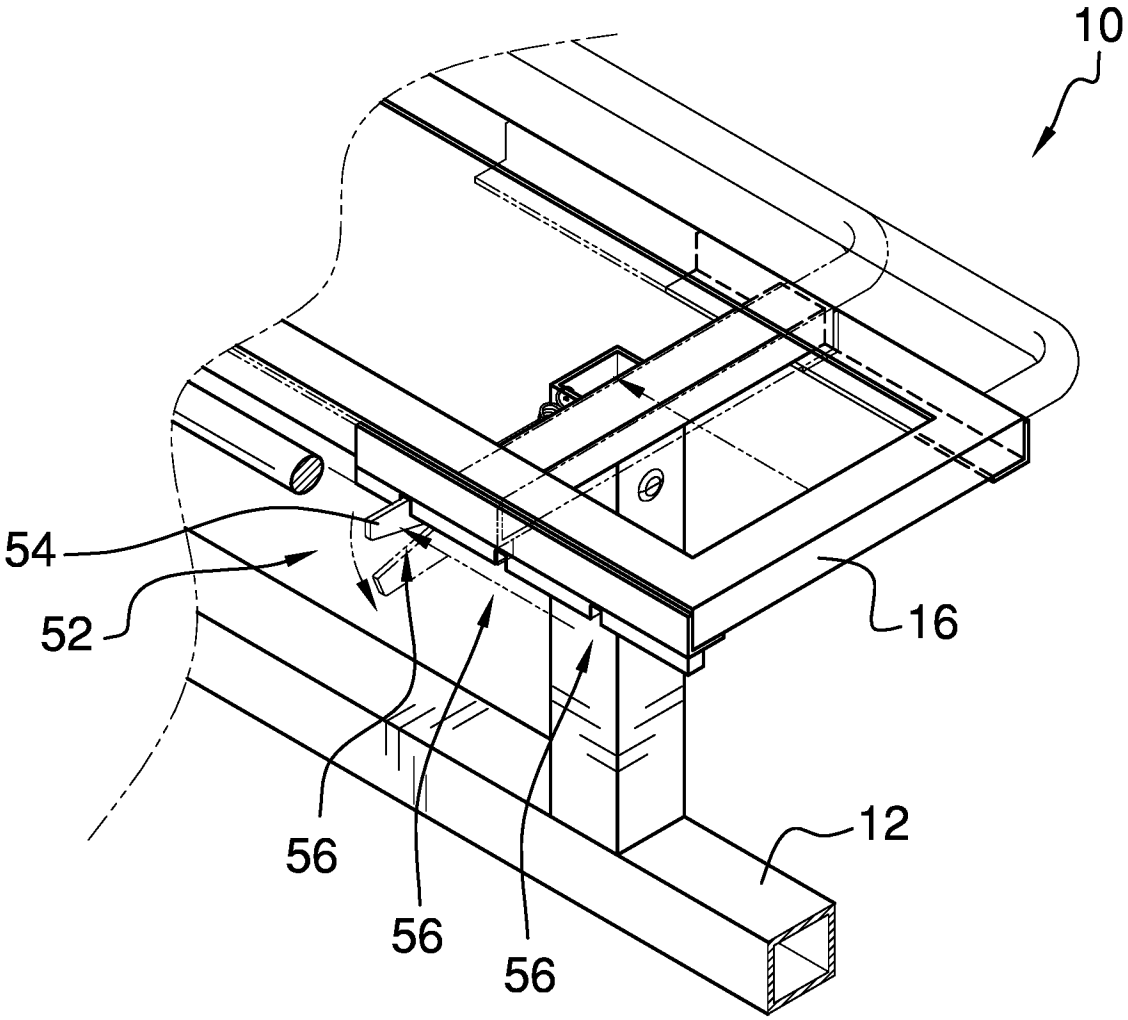
FIG. 6 is a detail perspective view of a platform position lock of an embodiment of the disclosure.
Figure 7:
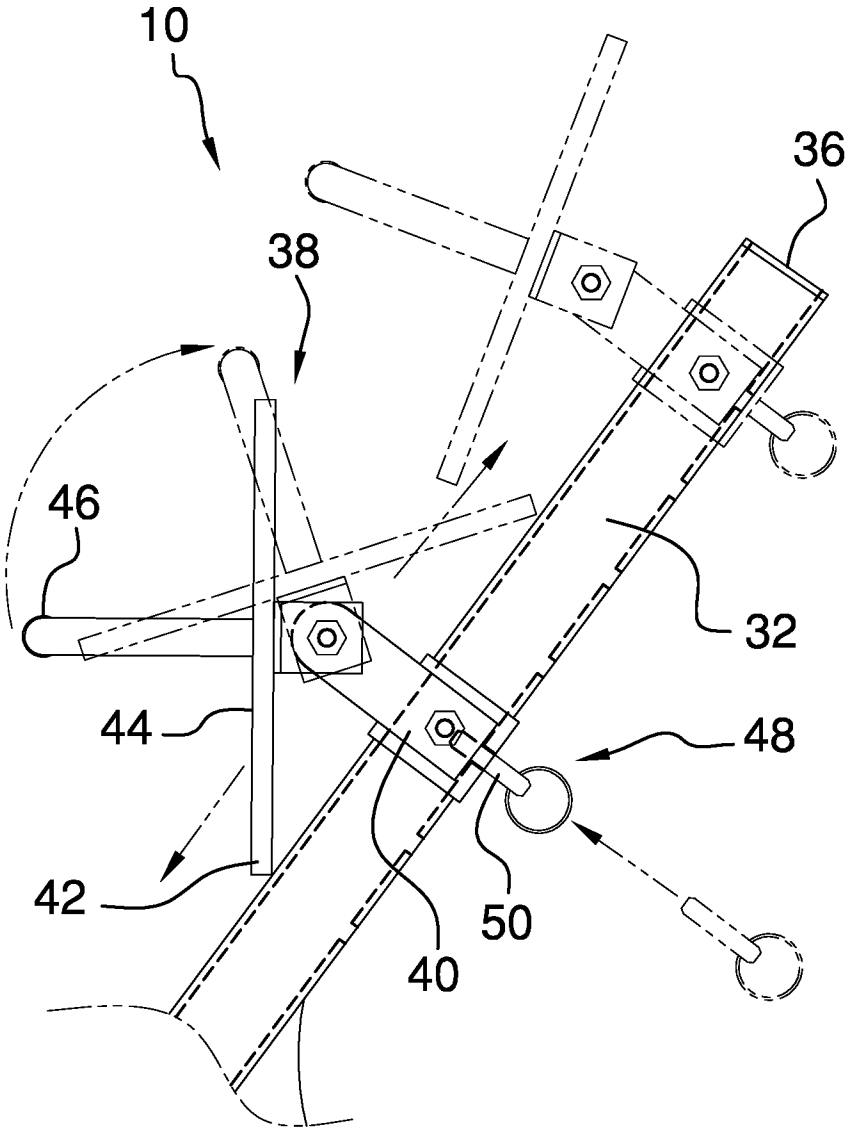
FIG. 7 is a detail side view of a foot engagement member of an embodiment of the disclosure.
Figure 8:
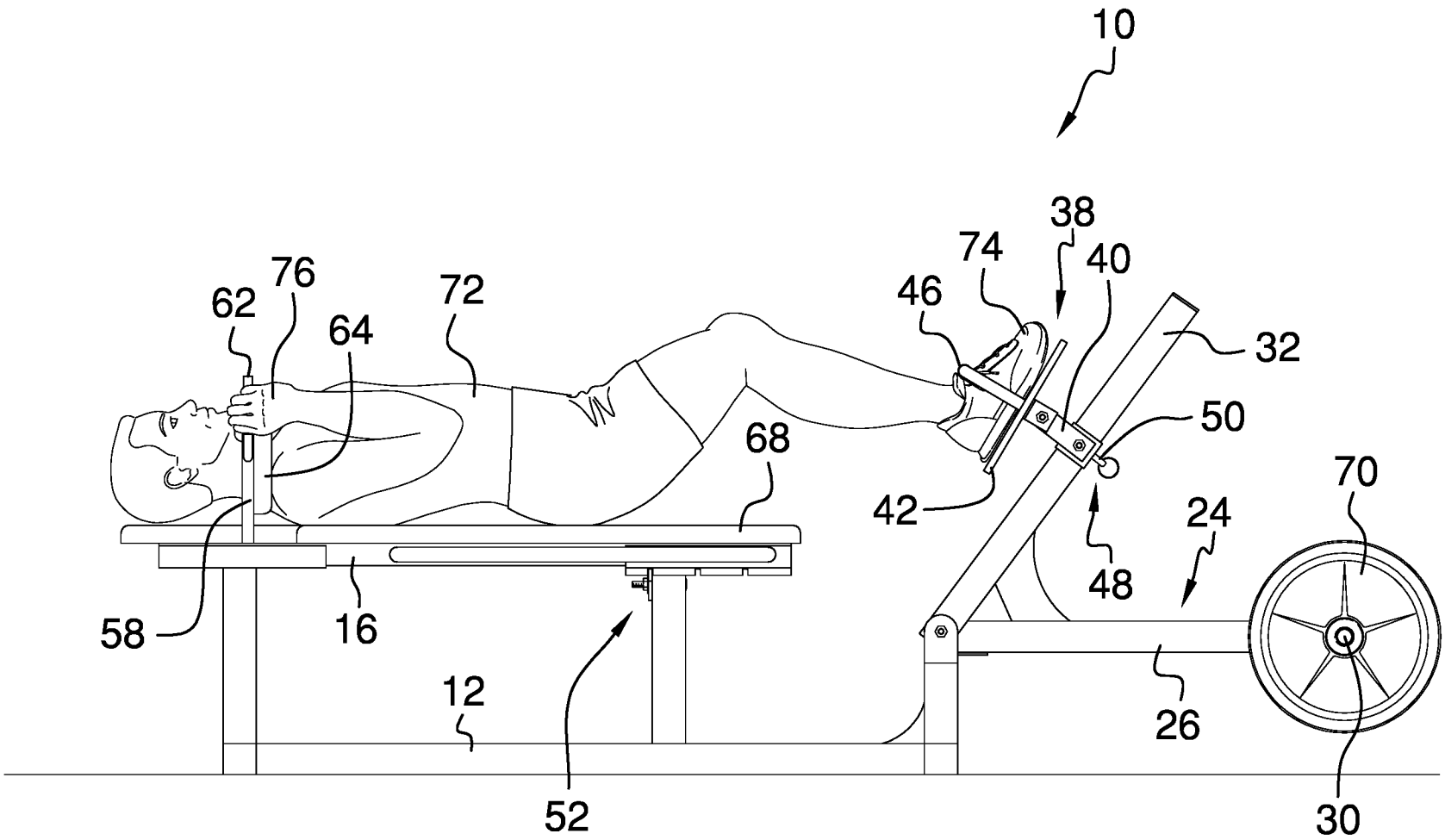
FIG. 8 is an in-use view of an embodiment of the disclosure before a user pulls a lever toward a platform.
Figure 9:
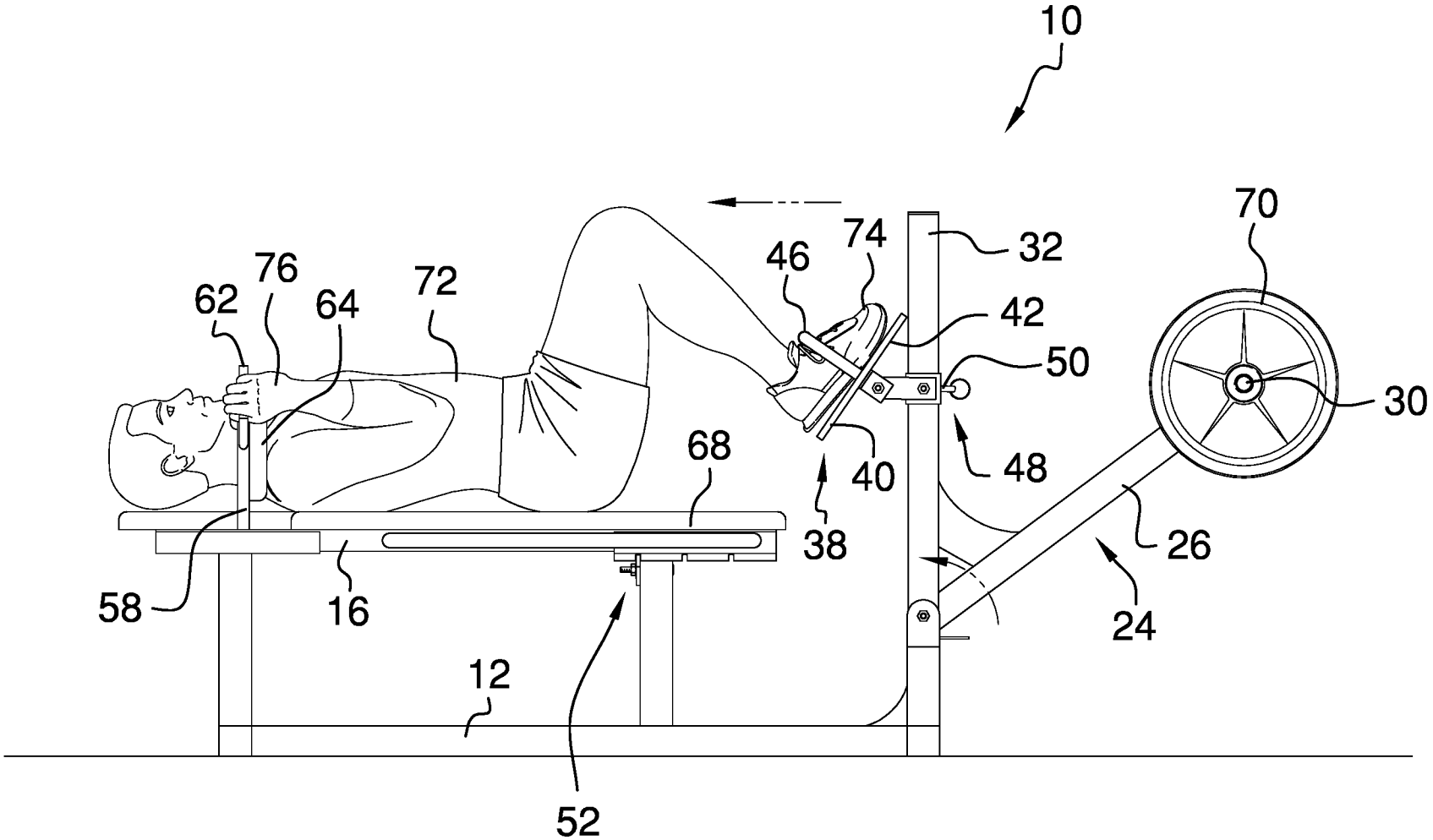
FIG. 9 is an in-use view of an embodiment of the disclosure after a user pulls a lever toward a platform.

With reference now to the drawings, and in particular to FIGS. 1 through 9 thereof, a new exercise apparatus embodying the principles and concepts of an embodiment of the disclosure and generally designated by the reference numeral 10 will be described.

As best illustrated in FIGS. 1 through 9, the exercise apparatus 10 generally comprises a base 12 and a platform 16 coupled to a top side 14 of the base 12. The platform 16 is slidable alternately forwardly and rearwardly with respect to the base 12. A weight support 24 is pivotally coupled to the base 12 and is spaced forwardly of the platform 16 with respect to the base 12. The weight support 24 comprises a post 26 and a weight bar 30. The post 26 is coupled to and extends away from the base 12. The weight bar 30 is coupled to the post 26 adjacent to a distal end 28 of the post 26 with respect to the base 12, extending laterally through the post 26 with respect to the base 12. The weight bar 30 is configured for being inserted through and holding plate weights 70. In other embodiments, the weight support 24 may comprise a container for holding weights in an interior space or another suitable shape for holding one or more weights.

A lever 32 is fixedly coupled to the weight support 24 and pivotally coupled to the base 12. The lever 32 forms a V-shape with the post 26 of the weight support 24. A foot engagement member 38 is coupled to the lever 32. The foot engagement member 38 comprises a bracket 40, a plate 42, and a pull bar 46. The bracket 40 is coupled to the lever 32 and is slidable between a proximal end 34 and a distal end 36 of the lever 32 with respect to the base 12. The plate 42 is coupled to the bracket 40 and has a support surface 44 which faces away from the lever 32. The support surface 44 is configured for supporting feet 74 of a user 72 and is pivotable with respect to the bracket 40. The pull bar 46 is coupled to the plate 42 and extends over the support surface 44 of the plate 42. The foot engagement member 38 also may comprise a strap, a clamp, or the like for engaging the user's 72 feet 74 such that the foot engagement member 38 may be urged toward the platform 16 via one or more of the feet 74.

A foot position lock 48 is couplable to the foot engagement member 38 and the lever 32 to secure the foot engagement member 38 to the lever 32 in a selected foot position. The foot position lock 48 comprises a locking pin 50 which is insertable through the lever 32 and the foot engagement member 38. The foot position lock 48 also may comprise a latch, a clamp, or the like to secure the foot engagement member 38 to the lever 32. A platform lock 52 is coupled to the platform 16 and is engageable to the base 12 to secure the platform 16 with respect to the base 12 in a desired platform position. The platform lock 52 includes a locking arm 54 which is biased to engage the base 12, and the base 12 defines a plurality of notches 56 for receiving the locking arm 54. The platform lock 52 also may comprise a latch, a clamp, or the like to secure the platform 16 in the desired platform position.

A pair of shoulder supports 58 is coupled to and extends upwardly from the platform 16. The shoulder supports 58 are positioned closer to a rear end 20 of the platform 16 than to a front end 18 of the platform 16 and are laterally spaced from each other with respect to the base 12. Each one of a pair of grips 62 is coupled to an outer side 60 of an associated shoulder support 58 of the pair of shoulder supports 58. Each one of a pair of shoulder cushions 64 is mounted to an associated shoulder support 58 of the pair of shoulder supports 58 and faces forwardly with respect to the base 12. A pair of handrails 66 is coupled to the platform 16. Each handrail 66 of the pair of handrails 66 is positioned on an associated lateral side 22 of a pair of lateral sides 22 of the platform 16 and extends between the front end 18 and the rear end 20 of the platform 16. A platform cushion 68 is mounted atop the platform 16.

In use, one or more plate weights 70 are loaded onto the weight bar 30 of the weight support 24. Securing means such as barbell collars, clamps, clips, latches, or the like may be used to secure the loaded plate weights 70 to the weight bar 30. The user 72 lies facing upwardly on the platform 16 and positions at least one of the user's 72 feet 74 between the plate 42 and the pull bar 46. The user 72 may rest the feet 74 against the support surface 44 of the plate 42 as desired. To exercise muscles involved in rotating the user's 72 femurs towards the user's 72 chest, the user 72 pulls the pull bar 46 with the feet 74 to move the lever 32 toward the platform 16 and lift the loaded plate weights 70. The user 72 may grasp the pair of grips 62 with the user's 72 hands 76 to aid in securing the user's 72 body to the platform 16. The exercise apparatus 10 may accommodate users of various heights by moving the foot engagement member 38 along the lever 32 and moving the platform 16 with respect to the base 12, securing each in desired positions. Changes in position to the foot engagement member 38 and the platform 16 may also be made to alter the range of motion taken when using the machine to exercise. Such alterations to the range of motion may lead to exercising different muscles or emphasizing exertion of certain muscles over others.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An exercise apparatus for use in a leg exercise, the exercise apparatus comprising:

a base;

a platform being coupled to a top side of the base;

a first pivot coupled to the base and spaced both a vertical distance below the platform and a horizontal distance forwardly of a free end of the platform with respect to the base;

a weight support being pivotally coupled to the base at the first pivot, the weight support being spaced forwardly of the free end of the platform with respect to the base, the weight support being shaped such that the weight support is configured to support a weight;

a lever being fixedly coupled to the weight support and pivotally coupled to the base at the first pivot, a free end of the lever being a vertical distance greater than a top side of the platform throughout use of the exercise apparatus; and a foot engagement member being coupled to the lever, the foot engagement member being shaped such that the foot engagement member is configured to be pulled toward the platform via a foot of a user.

2. The exercise apparatus of claim 1, wherein the platform is slidable alternately forwardly and rearwardly with respect to the base.

3. The exercise apparatus of claim 2, further comprising a platform lock being coupled to the platform and being engageable to the base to secure the platform with respect to the base in a desired platform position.

4. The exercise apparatus of claim 3, wherein the platform lock includes a locking arm which is biased to engage the base, the base defining a plurality of notches for receiving the locking arm.

5. The exercise apparatus of claim 1, wherein the weight support comprises a post and a weight bar, the post being coupled to and extending away from the base, the weight bar being coupled to the post adjacent to a distal end of the post with respect to the base, the weight bar extending laterally through the post with respect to the base, the weight bar being configured for being inserted through and holding plate weights.

6. The exercise apparatus of claim 5, wherein the lever forms a V-shape with the post of the weight support.

7. The exercise apparatus of claim 1, wherein the foot engagement member comprises:

a bracket being coupled to the lever;

a plate being coupled to the bracket, the plate having a support surface facing away from the lever, the support surface being configured for supporting the foot of the user, the plate being pivotable with respect to the bracket; and a pull bar being coupled to the plate, the pull bar extending over the support surface of the plate.

8. The exercise apparatus of claim 7, wherein the bracket is slidable between a proximal end and a distal end of the lever with respect to the base.

9. The exercise apparatus of claim 8, further comprising a foot position lock being couplable to the foot engagement member and the lever to secure the foot engagement member to the lever in a selected foot position.

10. The exercise apparatus of claim 9, wherein the foot position lock comprises a locking pin, the locking pin being insertable through the lever and the foot engagement member.

11. The exercise apparatus of claim 1, further comprising a pair of shoulder supports being coupled to and extending upwardly from the platform, the pair of shoulder supports being positioned closer to a rear end of the platform than to a front end of the platform, the pair of shoulder supports being laterally spaced from each other with respect to the base.

12. The exercise apparatus of claim 11, further comprising a pair of grips, each grip of the pair of grips being coupled to an outer side of an associated shoulder support of the pair of shoulder supports.

13. The exercise apparatus of claim 11, further comprising a pair of shoulder cushions, each shoulder cushion of the pair of shoulder cushions being mounted to an associated shoulder support of the pair of shoulder supports, each shoulder cushion of the pair of shoulder cushions facing forwardly with respect to the base.

14. The exercise apparatus of claim 1, further comprising a pair of handrails being coupled to the platform, each handrail of the pair of handrails being positioned on an associated lateral side of a pair of lateral sides of the platform, each handrail of the pair of handrails extending between a front end and a rear end of the platform.

15. The exercise apparatus of claim 1, further comprising a platform cushion being mounted atop the platform.

16. An exercise apparatus for use in a leg exercise, the apparatus exercise comprising:

a base;

a platform being coupled to a top side of the base, the platform being slidable alternately forwardly and rearwardly with respect to the base;

a weight support being pivotally coupled to the base, the weight support being spaced forwardly of the platform with respect to the base, the weight support comprising a post and a weight bar, the post being coupled to and extending away from the base, the weight bar being coupled to the post adjacent to a distal end of the post with respect to the base, the weight bar extending laterally through the post with respect to the base, the weight bar being configured for being inserted through and holding plate weights;

a lever being fixedly coupled to the weight support and pivotally coupled to the base via the weight support, the lever forming a V-shape with the post of the weight support;

a foot engagement member being coupled to the lever, the foot engagement member comprising:

a bracket being coupled to the lever, the bracket being slidable between a proximal end and a distal end of the lever with respect to the base;

a plate being coupled to the bracket, the plate having a support surface facing away from the lever, the support surface being configured for supporting feet of a user, the plate being pivotable with respect to the bracket; and a pull bar being coupled to the plate, the pull bar extending over the support surface of the plate;

a foot position lock being couplable to the foot engagement member and the lever to secure the foot engagement member to the lever in a selected foot position, the foot position lock comprising a locking pin, the locking pin being insertable through the lever and the foot engagement member;

a platform lock being coupled to the platform and being engageable to the base to secure the platform with respect to the base in a desired platform position, the platform lock including a locking arm which is biased to engage the base, the base defining a plurality of notches for receiving the locking arm;

a pair of shoulder supports being coupled to and extending upwardly from the platform, the pair of shoulder supports being positioned closer to a rear end of the platform than to a front end of the platform, the pair of shoulder supports being laterally spaced from each other with respect to the base;

a pair of grips, each grip of the pair of grips being coupled to an outer side of an associated shoulder support of the pair of shoulder supports;

a pair of shoulder cushions, each shoulder cushion of the pair of shoulder cushions being mounted to an associated shoulder support of the pair of shoulder supports, each shoulder cushion of the pair of shoulder cushions facing forwardly with respect to the base;

a pair of handrails being coupled to the platform, each handrail of the pair of handrails being positioned on an associated lateral side of a pair of lateral sides of the platform, each handrail of the pair of handrails extending between the front end and the rear end of the platform; and a platform cushion being mounted atop the platform.

* * * * *